US007048495B2

(12) United States Patent
Osgood

(10) Patent No.: US 7,048,495 B2
(45) Date of Patent: May 23, 2006

(54) ROTATING MACHINE HAVING A SHAFT INCLUDING AN INTEGRAL BEARING SURFACE

(75) Inventor: Christopher M. Osgood, Fairport, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 145 days.

(21) Appl. No.: 10/718,032

(22) Filed: Nov. 19, 2003

(65) Prior Publication Data

US 2005/0106015 A1 May 19, 2005

(51) Int. Cl.
*F01D 3/00* (2006.01)

(52) U.S. Cl. ..... 415/104; 415/229; 415/216.1

(58) Field of Classification Search ..... 415/216.1, 415/229, 104

See application file for complete search history.

(56) References Cited

U.S. PATENT DOCUMENTS 3,274,799 A * 9/1966 Danner ..... 415/216.1
3,647,314 A * 3/1972 Laessig ..... 415/207
4,013,384 A 3/1977 Oikawa
4,047,847 A 9/1977 Oikawa
4,120,618 A 10/1978 Klaus
5,026,253 A * 6/1991 Borger ..... 415/229
5,108,273 A * 4/1992 Romanyszyn, Jr. ..... 418/15
5,131,818 A 7/1992 Wittkop et al.
5,769,618 A 6/1998 Ono et al.
5,873,697 A 2/1999 Gully
6,364,646 B1 4/2002 Kirtley et al.
6,401,444 B1 * 6/2002 Knabel et al. ..... 57/404

* cited by examiner

*Primary Examiner*—Edward K. Look
*Assistant Examiner*—Igor Kershteyn
(74) *Attorney, Agent, or Firm*—Ware, Fressola, Van Der Sluys & Adolphson LLP

(57) ABSTRACT

A shaft (12) for a pump (10) or other rotating machine, made substantially out of only engineering plastic—such as the polymer PEEK or some other selected polymer—and including portions having respective surfaces (12*a–d*) serving as bearing surfaces, the shaft (12) thus integrating the functions of both a shaft structure and a bearing structure. In some applications, the shaft (12) includes both portions having respective surfaces serving as radial bearing surfaces (12*a–b*) and also portions having respective surfaces serving as thrust bearing surfaces (12*c–d*), all made from the same engineering plastic as the rest of the shaft (12) and formed as part of the shaft (12). The engineering plastic may include one or more additives such as PTFE or carbon fiber, especially in case of dry-run applications.

21 Claims, 1 Drawing Sheet

ROTATING MACHINE HAVING A SHAFT INCLUDING AN INTEGRAL BEARING SURFACE

TECHNICAL FIELD

The present invention pertains to rotating machines, such as pumps for pumping liquid, including centrifugal pumps. More particularly, the present invention pertains to the shaft and one or more bearings for such machines.

BACKGROUND ART

Centrifugal pumps—as one example of many kinds of rotating machines for which the invention may be used—are normally mechanically driven through induced magnetism created by a motor stator. In such pumps, a magnetic field interacts with a magnet included as part of a rotor mechanically attached to a shaft so as to rotate/drive the rotor assembly about the shaft. As the magnetic field causes the rotor to rotate, an attached impeller is also caused to rotate, which produces the pumping action of the pump. The pumping action, along with the magnetic forces through the stator and rotor produce both radial and axial forces that must be counter-balanced. Normally, in a wet rotor pump design (i.e. with the fluid being pumped in contact with the rotor), the forces are balanced by separate thrust and radial bearings, or some combination thereof, either attached to or acting on the rotor/shaft. The bearings serve to absorb forces and align the rotor about a centerline.

For high speed pumps (above about 12,000 RPM), normal bearing systems—such as those including ball bearings or carbon/ceramic bearing faces—tend not to last.

It would be advantageous to be able to provide a shaft that includes as an integral component—i.e. as a portion of the shaft—the bearings needed to counterbalance the radial and axial forces caused by driving the pump and caused by the pumping action. Such a shaft would have to be made of a material suitable for a bearing surface, which in case of high-speed applications is especially demanding.

U.S. Pat. No. 4,120,618 to Klaus describes a magnetic drive pump (as opposed to a wet rotor pump), with the magnetic drive pump having a shaft made out of a synthetic plastic, but the shaft synthetic plastic is apparently not of a material able to serve as a bearing surface, and so graphite and/or molybdenum disulfide or some other bearing material is imbedded in the shaft (only) at the locations where the shaft is to provide a bearing surface. Further, the plastic shaft described there interfaces with plastic material (the gap tube 7) of the pump described there, whereas it may be advantageous to have bearing surfaces on the shaft interface with a metallic bearing carrier (on the stator).

U.S. Pat. No. 5,769,618 discloses a flexible shaft having a rod-like member made from PEEK (poly-ether-ether-ketone). It is not a shaft about which a rotor rotates, but instead serves to couple a drive shaft to an external thread type rotor; the drive shaft is rotatably supported by ball bearings of a bearing unit. A metal rod is provided in the middle of the flexible shaft in a longitudinal direction, or a metal sleeve is mounted over the outer surface of the flexible shaft. The flexible shaft does not have on it a bearing surface.

U.S. Pat. No. 5,131,818 describes the use of PEEK material as a cylinder bushing in a reciprocating piston pump. There is no teaching or description of the use of PEEK material for making a shaft, let alone a shaft having a bearing surface.

U.S. Pat. No. 5,873,697 describes using PEEK material as a centrifugal pump wear ring for helping to control impeller wear ring clearances. There is no teaching or suggestion of using PEEK material for making a shaft having a bearing surface.

U.S. Pat. No. 4,047,847 teaches the use of a ceramic shaft, not a shaft made of engineering plastic, and teaches the use of a rotor formed of synthetic resin. There is no teaching or suggestion of using engineering plastic such as PEEK in making a shaft having a bearing surface.

Thus, despite prior art teaching making a shaft, what is still needed is a shaft that includes a bearing surface as an integral component, thereby providing a rotating machine having fewer separate components and so potentially reducing manufacturing/assembly costs and improving reliability.

DISCLOSURE OF THE INVENTION

Accordingly, in a first aspect of the invention, a shaft is provided for a rotating machine, characterized in that: the shaft is made substantially out of only engineering plastic and includes a portion having one or more surfaces serving as respective bearing surfaces and formed from the same engineering plastic as the rest of the shaft, the shaft thereby integrating the functions of both a shaft structure and one or more bearing structures.

In accord with the first aspect of the invention, the engineering plastic may be a material including a selected polymer, which may be poly-ether-ether-ketone (PEEK), or may be polyimide.

Also in accord with the first aspect of the invention, carbon fiber or graphite or polytetrafluoroethylene (PTFE) or other comparable material may be substantially uniformly distributed throughout the engineering plastic material.

Also in accord with the first aspect of the invention, the shaft may include one or more portions having respective surfaces serving as respective radial bearing surfaces and one or more portions having respective surfaces serving as respective thrust bearing surfaces. Further, at least some of the one or more bearing surfaces may mate with corresponding stator bearing surfaces of the rotating machine during operation of the rotating machine.

In a second aspect of the invention, a rotating machine is provided, comprising a shaft according to the first aspect of the invention.

In accord with the second aspect of the invention, the rotating machine may be adapted so that at least the bearing surface is lubricated or wet during operation in a wet-rotor application.

Also in accord with the second aspect of the invention, the rotating machine may be a pump.

Also in accord with the second aspect of the invention, a magnet or other structure not necessarily made from the engineering plastic may be mechanically attached or bonded to the shaft.

Also in accord with the second aspect of the invention, the rotating machine may be a wet-rotor pump.

Also in accord with the second aspect of the invention, the rotating machine may be a centrifugal pump.

Also in accord with the second aspect of the invention, the shaft may be included in a rotor, and the rotating machine further may comprise a stator having one or more bearing surfaces corresponding to the one or more bearing surfaces of the shaft and made of an engineering plastic.

In a third aspect of the invention, a method is provided for making a shaft according to the first aspect of the invention.

BRIEF DESCRIPTION OF THE DRAWINGS

The above and other objects, features and advantages of the invention will become apparent from a consideration of the subsequent detailed description presented in connection with the accompanying drawing, which is a schematic cross section of a centrifugal pump having a shaft according to the invention, and so having bearing surfaces as an integral portion of the shaft.

BEST MODE FOR CARRYING OUT THE INVENTION

Figure 1:
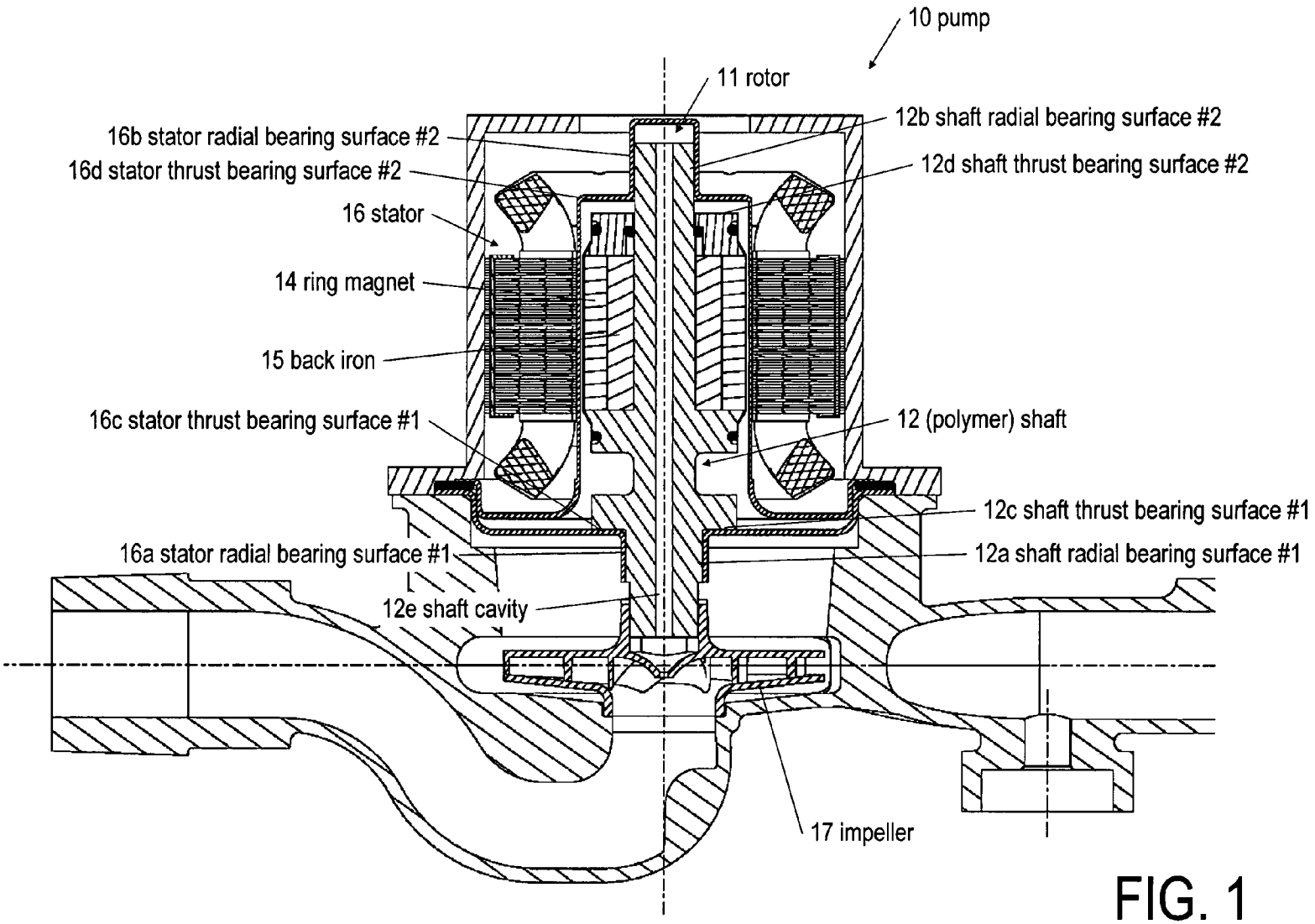

The invention provides a pump or other rotating machine including a shaft having a bearing surface as an integral component. More specifically, the invention provides a shaft for a rotating machine made substantially out of only engineering plastic and including as an integral component (i.e. formed at the same time as the shaft proper) a portion having a surface serving as a bearing interface, thereby integrating the functions of both a shaft and the usually separately formed bearings.

The invention is described here in terms of a centrifugal pump, but as should be clear from the description, nothing about a shaft according to the invention restricts such a shaft to use in a centrifugal pump. A shaft according to the invention can be used in any kind of pump in which the shaft is wet during operation, i.e. any kind of wet rotor pump. Further, it may be possible to use the invention in other kinds of pumps and in other kinds of rotating machinery (e.g. compressors, turbines, electric motors, etc.), especially in case the bearing surface of the shaft is or can be lubricated during operation. Even further, the invention can be used up to some PV limit even in case of dry rotors, with no lubrication, at least for some period of time.

Referring now to the drawing (FIG. 1), a centrifugal pump 10 is shown as including a rotor 11 having a shaft 12 according to the invention, and so formed from a selected polymer, such as poly-ether-ether-ketone (PEEK) or polyimide (Vespel TP series), and having one or more bearing surfaces 12*a–d* formed as portions of the shaft 12. For dry rotor applications (including possibly applications in which the rotor runs dry only momentarily during startup), a material that is a mixture of PEEK (or some other selected polymer, such as polyimide) and one or more of various additives including graphite, polytetrafluoroethylene (PTFE) (i.e. TEFLON, which is a registered trademark of Dupont), or carbon fiber can be used; thus, in such applications, the rotor can be a material that is substantially a selected polymer but also includes graphite, PTFE, and carbon fiber uniformly distributed during molding throughout the selected polymer. For wet rotor applications (but even in case of some dry rotor applications, and especially for applications in which the rotor runs dry only during startup), natural/unfilled PEEK (or other selected polymer) can be used. In particular, PEEK provided as PEEK 450FC30 (with carbon fiber, graphite, and PTFE—good even for dry run applications) or PEEK450P (no fillers—good usually only for wet-rotor applications) both available from VICTREX PLC can be used. It is important to understand that the bearing surfaces 12*a–d* are not mechanically attached or bonded to the rest of the shaft 12, but are in fact formed as part of the shaft during its manufacture (e.g. using injection molding techniques).

Besides the shaft 12, the rotor 11 includes a ring magnet 14, and a back-iron structure 15 behind the ring magnet and mechanically attached or bonded to the ring magnet (or a back iron integral with the ring magnet). The magnet/back iron combination 14 15 is itself mechanically attached or bonded to the shaft 12. The pump 10 also includes a stator 16 that produces a rotating magnetic field that in turn produces magnetic forces that rotate the shaft. Beside providing torque for rotating the shaft 12, the magnetic field from the stator 16 also produces radial and axial forces acting on the shaft.

The shaft has an impeller 17 attached at one terminus, and as the shaft is caused to rotate, the impeller also rotates, creating radial and axial hydraulic forces, which are then in addition to the radial and axial forces caused by the magnetic field coming from the stator 16.

The invention also advantageously provides a second (rotor) thrust bearing surface 12*d*—not necessarily integral with the shaft—and a corresponding stator thrust bearing surface 16*d* to protect against up-thrust.

The radial forces are counterbalanced using preferably two radial bearing surfaces 12*a–b*, one at each end of the shaft 12 and provided as integral with the shaft. The (rotor) radial bearing surfaces 12*a–b* mate with corresponding stator radial bearing surfaces 16*a–b* on the stator 16, as shown.

The stator thrust and radial bearing surfaces 16*a–d* can be metallic or can also be a selected (hard/tough) polymer (such as PEEK), or can be a (softer/weaker) polymer, not by itself appropriate as a bearing material, but including embedded materials suitable for use as a bearing surface.

The rotor and stator bearing surfaces 12*a–d* 16*a–d* should have a separation/clearance pre-determined to be appropriate for a hydro-dynamic bearing system in case of a wet-rotor application. The shaft 12 can have a centerline bore/cavity 12*e*, and water circulating through the shaft cavity and shaft and through the clearance in the bearing surfaces can then produce a hydro-dynamic medium, add lubrication, and cool the bearing surfaces.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A shaft (12) for a rotating machine (10), characterized in that: the shaft (12) is made substantially out of engineering plastic and includes a portion (12*a–d*) having one or more surfaces (12*a–d*) serving as respective bearing surfaces and formed from the same engineering plastic as the rest of the shaft (12), the shaft (12) thereby integrating the functions of both a shaft structure and one or more bearing structures;

wherein the shaft (12) includes one or more portions (12*a–b*) having respective surfaces serving as respective radial bearing surfaces and one or more portions (12*c–d*) having respective surfaces serving as respective thrust bearing surfaces.

2. The shaft (12) of claim 1, wherein the engineering plastic is a material including a selected polymer.

3. The shaft (12) of claim 2, wherein the selected polymer is poly-ether-ether-ketone (PEEK).

4. The shaft (12) of claim 2, wherein the selected polymer is polyimide.

5. The shaft (12) of claim 1, wherein carbon fiber is substantially uniformly distributed throughout the engineering plastic material.

6. The shaft (12) of claim 1, wherein graphite is substantially uniformly distributed throughout the engineering plastic material.

7. The shaft (12) of claim 1, wherein polytetrafluoroethylene (PTFE) is substantially uniformly distributed throughout the engineering plastic material.

8. The shaft (12) of claim 1, further characterized in that at least some of the one or more bearing surfaces (12*a–d*) mate with corresponding stator bearing surfaces (16*a–d*) of the rotating machine (10) during operation of the rotating machine (10).

9. A rotating machine (10), comprising a shaft (12) according to claim 1.

10. A rotating machine (10) as in claim 9, wherein the rotating machine (10) is adapted so that at least the bearing surface (12*a–d*) is lubricated or wet during operation in a wet-rotor application.

11. A rotating machine (10) as in claim 9, wherein the rotating machine (10) is a pump.

12. A rotating machine (10) as in claim 9, wherein a structure not made from the engineering plastic is mechanically attached or bonded to the shaft (12).

13. A rotating machine (10) as in claim 9, wherein the rotating machine (10) is a wet-rotor pump.

14. A rotating machine (10) as in claim 9, wherein the rotating machine (10) is a centrifugal pump.

15. A rotating machine (10) as in claim 9, wherein the shaft is included in a rotor (11), and the rotating machine further comprises a stator (16) having one or more bearing surfaces (16*a–d*) corresponding to the one or more bearing surfaces (12*a–d*) of the shaft (12) and made of an engineering plastic.

16. A method for making a shaft (12) for a rotating machine (10), characterized by: making the shaft (12) substantially out of engineering plastic and including a portion (12*a–d*) having one or more surfaces (12*a–d*) serving as respective bearing surfaces and formed from the same engineering plastic as the rest of the shaft (12), wherein the shaft (12) includes one or more portions (12*a–b*) having respective surfaces serving as respective radial bearing surfaces and one or more portions (12*c–d*) having respective surfaces serving as respective thrust bearing surfaces, thereby integrating into the shaft (12) the functions of both a shaft structure and one or more bearing structures.

17. The method of claim 16, wherein the engineering plastic is a material including a selected polymer.

18. The shaft of claim 17, wherein the selected polymer is poly-ether-ether-ketone (PEEK).

19. The method of claim 17, wherein the selected polymer is polyimide.

20. A centrifugal pump (10), comprising a shaft (12), characterized in that: the shaft (12) is made substantially out of engineering plastic and includes a portion (12*a–d*) having one or more surfaces (12*a–d*) serving as respective bearing surfaces and formed from the same engineering plastic as the rest of the shaft (12), the shaft (12) thereby integrating the functions of both a shaft structure and one or more bearing structures.

21. A method for making a centrifugal pump having a shaft (12), characterized by: making the shaft (12) substantially out of engineering plastic and including a portion (12*a–d*) having one or more surfaces (12*a–d*) serving as respective bearing surfaces and formed from the same engineering plastic as the rest of the shaft (12), thereby integrating into the shaft (12) the functions of both a shaft structure and one or more bearing structures.

* * * * *